US007711283B2

(12) United States Patent
Iwai

(10) Patent No.: US 7,711,283 B2
(45) Date of Patent: May 4, 2010

(54) IMAGE FORMING METHOD AND IMAGE FORMING APPARATUS

(75) Inventor: Sadayuki Iwai, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 882 days.

(21) Appl. No.: 11/475,162

(22) Filed: Jun. 27, 2006

(65) Prior Publication Data

US 2007/0003315 A1 Jan. 4, 2007

(30) Foreign Application Priority Data

Jun. 30, 2005 (JP) ..... 2005-193044

(51) Int. Cl.
*G03G 15/02* (2006.01)

(52) U.S. Cl. ..... 399/100; 399/50; 399/174; 399/175; 399/176

(58) Field of Classification Search ..... 399/50, 399/100, 174–176
See application file for complete search history.

(56) References Cited

U.S. PATENT DOCUMENTS

| | | | | |
|---|---|---|---|---|
| 5,708,938 | A | 1/1998 | Takeuchi | |
| 5,809,388 | A | 9/1998 | Inada | |
| 5,864,737 | A | 1/1999 | Obu | |
| 5,923,930 | A | 7/1999 | Tsukamoto | |
| 5,987,281 | A | 11/1999 | Kurotori | |
| 5,987,282 | A | 11/1999 | Tsukamoto | |
| 6,115,576 | A | 9/2000 | Nakano | |
| 6,347,212 | B1 | 2/2002 | Kosugi | |
| 6,611,672 | B2 | 8/2003 | Aoki | |
| 6,757,512 | B2 | 6/2004 | Miyawaki | |
| 6,792,222 | B2 | 9/2004 | Iwai | |
| 6,889,030 | B2 | 5/2005 | Koide | |
| 6,912,370 | B2 | 6/2005 | Iwai | |
| 6,934,482 | B2 | 8/2005 | Iwai | |
| 6,947,682 | B2 | 9/2005 | Kosugi | |
| 2001/0026694 | A1 * | 10/2001 | Sakaizawa et al. | 399/50 |
| 2001/0048990 | A1 | 12/2001 | Iwai | |
| 2004/0126148 | A1 | 7/2004 | Iwai | |
| 2004/0170451 | A1 | 9/2004 | Iwai | |
| 2004/0179869 | A1 | 9/2004 | Miyawaki | |

FOREIGN PATENT DOCUMENTS

| | | |
|---|---|---|
| JP | 06-348110 | 12/1994 |
| JP | 06-348112 | 12/1994 |
| JP | 06-348114 | 12/1994 |
| JP | 2002-229307 | 8/2002 |
| JP | 2004-361916 | 12/2004 |

* cited by examiner

*Primary Examiner*—David M Gray
*Assistant Examiner*—Laura K Roth
(74) *Attorney, Agent, or Firm*—Harness, Dickey & Pierce, P.L.C.

(57) ABSTRACT

An image forming method and apparatus is disclosed. The method may include charging a rotating latent image bearing member with a rotating charger selected from at least one of contact chargers and short range chargers; irradiating the rotating latent image bearing member with imagewise light to form an electrostatic latent image on the latent image bearing member; developing the electrostatic latent image with a developer including a toner having a charge to form a toner image on the latent image bearing member; transferring the toner image onto a receiving material; and forming an electric field between the charger and the latent image bearing member after the toner image transferring such that charged materials present on the surface of the charger fly toward the latent image bearing member.

11 Claims, 5 Drawing Sheets

IMAGE FORMING METHOD AND IMAGE FORMING APPARATUS

BACKGROUND OF THE INVENTION

1. Field of the Invention

The present invention relates to an image forming method and an image forming apparatus utilizing an image forming process such as electrophotography and electrostatic recording. More particularly, the present invention relates to an image forming method and an image forming apparatus in which an image bearing member can be uniformly charged.

2. Discussion of the Background

Image forming apparatus utilizing an image forming process such as electrophotography and electrostatic recording typically include the following processes:

(1) uniformly charging the surface of a latent image bearing member such as photoreceptors (charging process);

(2) irradiating the charged latent image bearing member with light including image information to form an electrostatic latent image on the latent image bearing member (electrostatic latent image forming process);

(3) developing the electrostatic latent image with a developer including a toner to form a toner image on the latent image bearing member (developing process);

(4) transferring the toner image to a receiving material such as papers optionally via an intermediate transfer medium (transfer process); and (5) fixing the toner image on the receiving material, resulting in output of an image (fixing process).

In the charging process, corotron chargers using corona discharging and scorotron chargers which are modified corotron chargers and which are modified so as to be able to uniformly charge latent image bearing members have been used. Corotron chargers and scorotron chargers (hereinafter referred to as charging methods utilizing aerial discharging) typically include an electroconductive wire (such as tungsten wires) and a counter electrode which is set 5 to 10 mm apart from the wire. By applying a high voltage to the wire, the molecules in the air surrounding the wire are excited and ionized, resulting in formation of charged particles. The charged particles thus formed adhere to the surface of a latent image bearing member, thereby charging the latent image bearing member.

Although the charging methods utilizing aerial discharging have an advantage such that an image bearing member can be uniformly charged, the charging methods have drawbacks such that a large amount of discharge products such as ozone and NOx are generated due to ionization of molecules in the air; and the chargers are not easy to handle.

In attempting to remedy the drawbacks, other charging methods have been developed. For example, charging rollers made of an electroconductive material such as electroconductive rubbers and resins or charging brushes made of an electroconductive material such as electroconductive fibers have been developed. By contacting such charging rollers or brushes with an image bearing member, charges are directly transported to the image bearing member (this charging device is hereinafter referred to as contact charging device). Alternatively, the chargers may be set close to an image bearing member such that charges formed by discharging at a small gap therebetween are transported to the image bearing member (this charging device is hereinafter referred to as charge injection type charging device).

The contact charging devices typically use a roller having an outermost layer made of a rubber as disclosed in published unexamined Japanese patent applications Nos. (hereinafter referred to as JP-As) 06-348110, 06-348112 and 06-348114.

JP-A 06-348110 discloses a charging roller having a layered structure such that an elastic layer including a pressure sensitive electroconductive rubber is formed on a metal shaft and an outermost layer is formed on the elastic layer. In the charging roller, the pressure applied to the roller is adjusted such that the image bearing member is uniformly charged so as to have a predetermined potential over a long period of time.

JP-A 06-348112 discloses a technique such that a photoreceptor is charged by a DC direct charging method so as to have a relatively low potential of from 300 to 650V. It is described therein that by using this technique, the photoreceptor can be uniformly charged and therefore good images without defective images such as streak images can be formed.

JP-A 06-348114 discloses a technique in that the electric properties of the charging roller are checked when the charging roller is located on a non-image area of the photoreceptor to be charged. If it is detected that the electric properties of the charging roller are changed, the conditions for DC charging are changed depending on the electric property changes such that the photoreceptor can be uniformly charged to have a predetermined potential.

Although these contact charging devices have an advantage such that the amount of discharge products such as ozone and NOx can be reduced, the devices have a drawback such that foreign materials remaining on the surface of the photoreceptor are transferred to the charging roller, resulting in contamination of the charging roller. When the charging roller is contaminated, the surface of the charging roller cannot be uniformly contacted with the surface of the photoreceptor, resulting in uneven charging of the photoreceptor. Alternatively, the resistance of the surface of the charging roller is changed due to the adhered foreign materials, and thereby the charging roller cannot uniformly charge the photoreceptor. When the charging roller is contaminated, the charging device including the charging roller or the process unit including the charging device has to be replaced with new one. This replacement operation is troublesome for users and increases the running costs.

In attempting to remedy the drawback of the contact charging devices, JP-A 2002-229307 discloses a short range charger in which a charging roller is set close to a photoreceptor with a small gap therebetween to uniformly charge the photoreceptor.

By using this charger, the chance of occurrence of the charging roller contamination problem can be reduced. However, foreign materials, which remain on the surface of a photoreceptor even after a cleaning process and which have a charge, fly to the surface of the charging roller, resulting in adhesion of the materials to the surface of the charging roller. In addition, when the charging roller applies a combination of a DC bias and an AC bias, charges are induced in the residual foreign materials on the surface of the photoreceptor or in the air surrounding the charging roller even when the foreign materials are not charged. The thus charged foreign materials also fly to the charging roller due to the AC bias effect. When such flying foreign materials are contacted with the charging roller, the materials are adhered thereto by means of a physical adhesion force such as van der Waals force.

The amount of the foreign materials thus adhered to the surface of a photoreceptor is much smaller than that in a case using a contact charging roller. However, when the charging roller is used for a long period of time and such foreign materials are adhered to the surface of the charging roller, the above-mentioned defective charging problem is caused.

When a short range charging device is used, a cleaning device is typically provided to clean the surface of such a short range charging roller. In this case, when a passage through which the materials collected by the cleaning device are transported to be discharged from the cleaning device is provided, the image forming apparatus is jumboized. Therefore, the collected materials are typically contained in the cleaning device. In this case, when the cleaning device is fully filled with the collected materials, the cleaning device has to be replaced with new one (i.e., the life of the cleaning device expires).

In the case of contact charging rollers, there is a possibility that the foreign materials adhered to the surface of the contact charging rollers are transferred to the surface of the photoreceptor. However, in the case of short range charging rollers, the foreign materials adhered to the surface of the contact charging rollers are hardly transferred to the surface of the photoreceptor.

Because of these reasons, a need exists for a cleaning method for removing foreign materials on a charging member without using a mechanical cleaning device such as cleaning blades.

SUMMARY OF THE INVENTION

As a first aspect of the present invention, an image forming method is provided which includes the steps of:

charging a latent image bearing member with a charger selected from the group consisting of contact chargers and short range chargers;

irradiating the latent image bearing member with imagewise light to form an electrostatic latent image on the latent image bearing member; and forming an electric field between the charger and the latent image bearing member after toner image transferring such that charged materials present on the surface of the charger fly toward the latent image bearing member.

As another aspect of the present invention, an image forming apparatus is provided which includes:

a latent image bearing member;

a charger configured to charge the surface of the latent image bearing member;

a light irradiator configured to irradiate the charged latent image bearing member with imagewise light to form an electrostatic latent image on the latent image bearing member;

a developing device configured to develop the electrostatic latent image with a developer including a toner to form a toner image on the latent image bearing member;

a transferring device configured to transfer the toner image onto a receiving material; and an electric field applicator configured to form an electric field between the charger and the latent image bearing member after the toner image on the latent image bearing member is transferred such that charged materials present on the surface of the charger fly toward the latent image bearing member.

As a yet another aspect of the present invention, a process cartridge is provided which includes at least the latent image bearing member, the charger and the electric field applicator mentioned above and which is detachably set to an image forming apparatus as a unit.

These and other objects, features and advantages of the present invention will become apparent upon consideration of the following description of the preferred embodiments of the present invention taken in conjunction with the accompanying drawings.

DETAILED DESCRIPTION OF THE INVENTION

Figure 1:
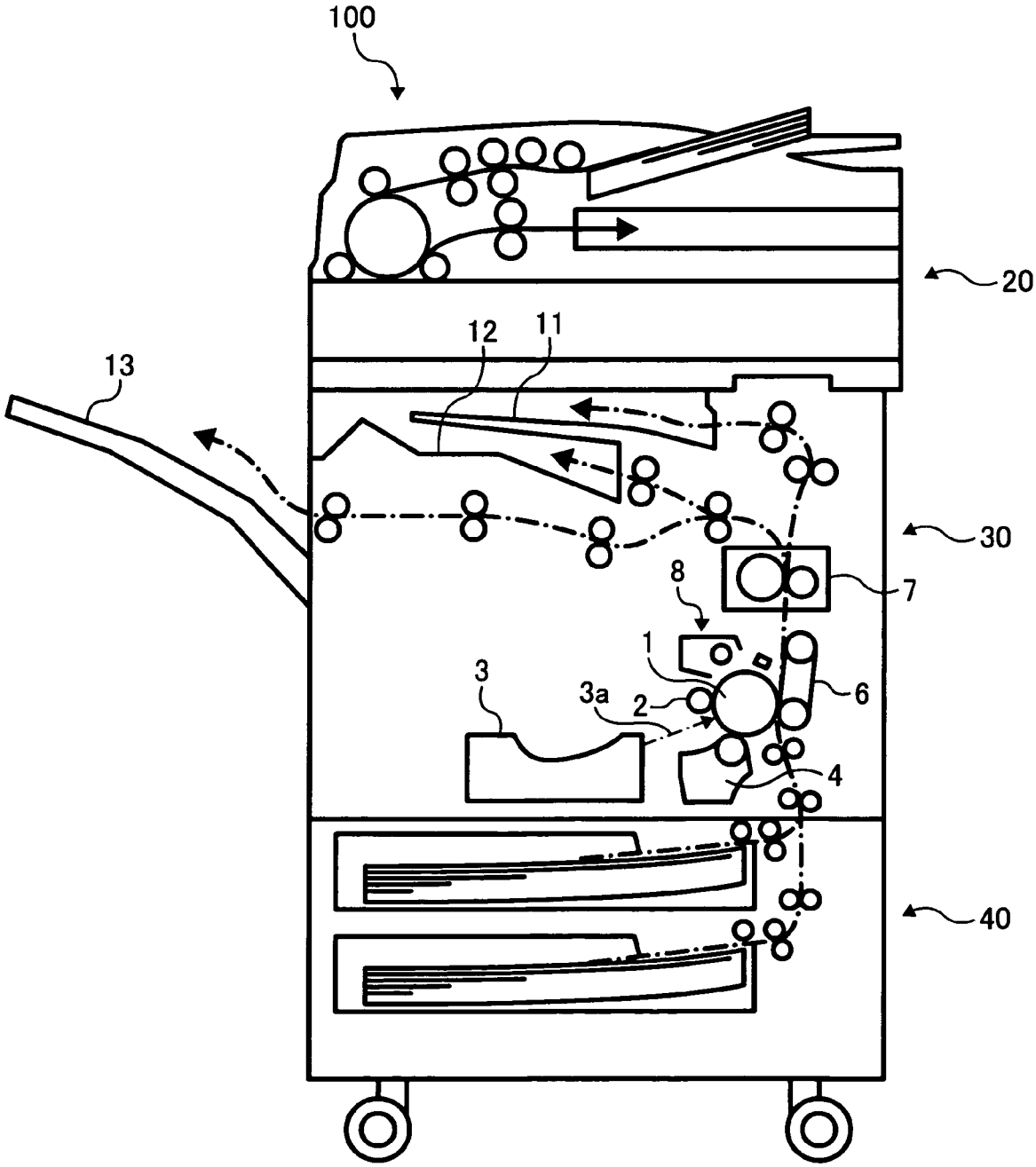
FIG. 1 is a schematic view illustrating an example of the image forming apparatus of the present invention.
Figure 2:
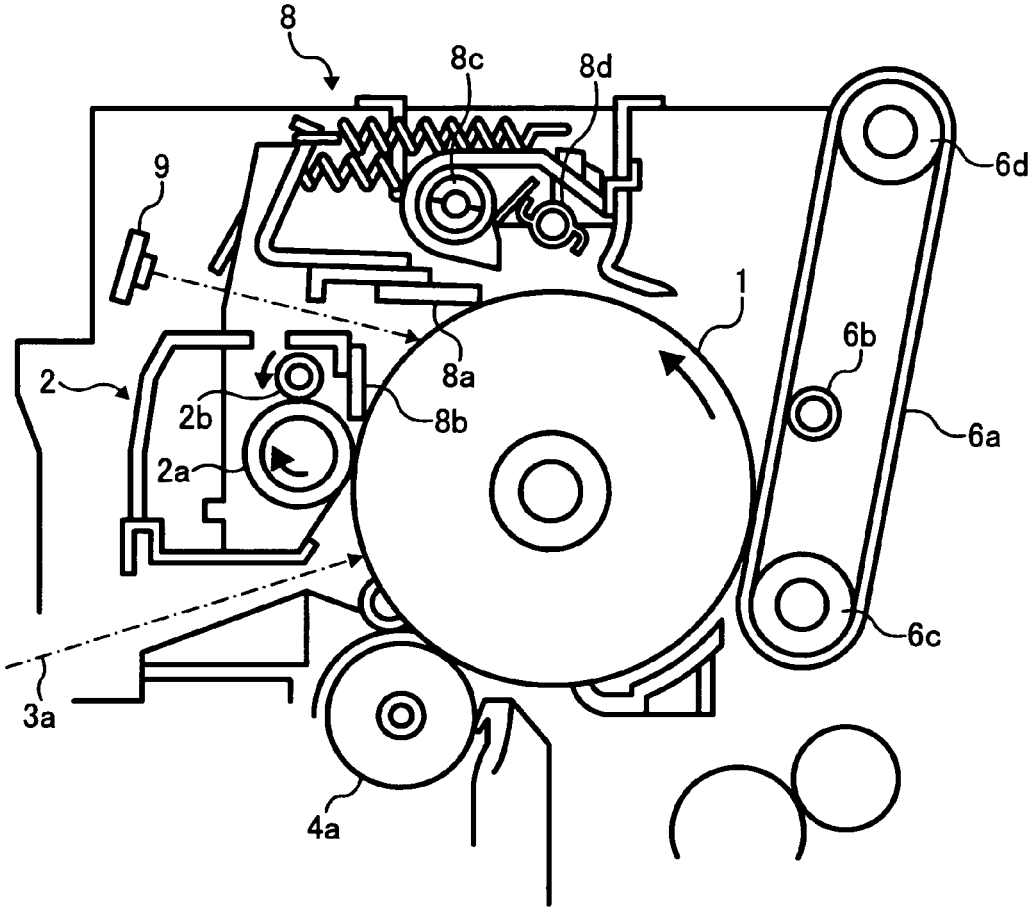
FIG. 2 is a schematic view illustrating the image forming section of the image forming apparatus illustrated in FIG. 1.

FIG. 1 is a schematic view illustrating an example of the image forming apparatus of the present invention. FIG. 2 is a schematic view illustrating the image forming section of the image forming apparatus illustrated in FIG. 1. The image forming section includes a cleaner configured to clean a charger.

Referring to FIG. 1, an image forming apparatus 100 includes an image reading section 20 configured to read images of original documents, an image forming section 30 configured to reproduce the images, and a receiving material storage/feeding section 40 configured to feed sheets of receiving materials toward the image forming section 30. The image forming section 30 includes a drum-shaped photoreceptor 1 serving as a latent image bearing member. Around the photoreceptor 1, a charger 2 configured to charge the surface of the photoreceptor 1, a light irradiator 3 configured to irradiate the charged photoreceptor with imagewise light to form an electrostatic latent image on the photoreceptor 1, a developing device 4 configured to develop the electrostatic latent image with a developer including a toner to form a toner image on the photoreceptor 1, a transfer device 6 configured to transfer the toner image onto a receiving material and a cleaning device 8 configured to clean the surface of the photoreceptor 1 are arranged. The receiving material bearing the toner image thereon is fed toward a fixing device 7. The receiving material on which the toner image is fixed is then discharged from the main body of the image forming apparatus to be stacked on one of trays 11, 12 and 13.

The photoreceptor 1 includes a photosensitive material such as amorphous materials, e.g., amorphous silicon and amorphous selenium, and organic compounds, e.g., bisazo pigments and phthalocyanine pigments. Among these photosensitive materials, organic compounds are preferably used because of being friendly to environment and being easy to handle when the photoreceptors are treated to be recycled or disposed of.

When an organic photosensitive compound is used for the photoreceptor 1, a protective layer is preferably formed as an outermost layer of the photoreceptor such that the surface of the photoreceptor is not easily abraded. For example, layers including a particulate inorganic material such as silica, alumina, zinc oxide and titanium oxide in an amount of from 3 to 70% by weight, and layers including a crosslinked resin are used for the protective layer. By forming such a protective layer as an outermost layer of the photoreceptor 1, the resistance of the photoreceptor 1 to rubbing of a cleaning blade, which is typically included in the cleaning device 8, can be improved.

Figure 3:
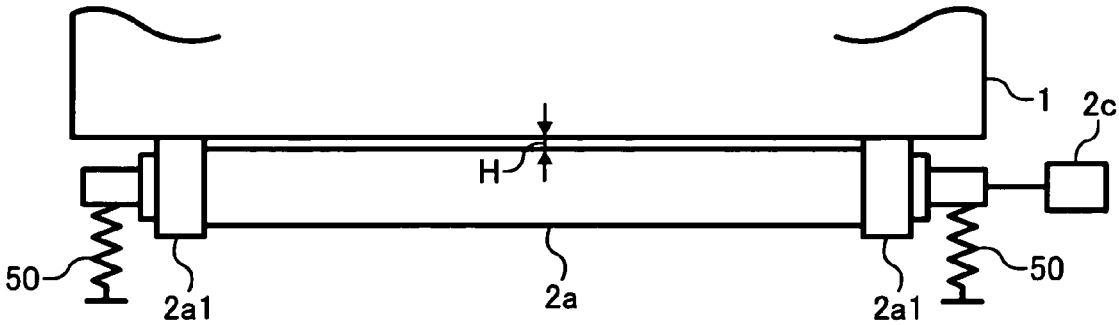
FIG. 3 is a schematic view illustrating the photoreceptor and charging roller of the image forming apparatus illustrated in FIG. 1.

Referring to FIG. 2, the charger 2 includes a charging roller 2*a* arranged so as to be close to the photoreceptor 1, and a power source 2*c* illustrated in FIG. 3 which is connected to the charging roller 2*a* and which serves as an electric field applicator and applies a voltage to the charging roller. The charging roller 2*a* includes a metal shaft and an elastic layer or a resin layer, which is formed on the metal shaft.

In the charger 2, a predetermined voltage is applied to the charging roller 2*a* to perform short range discharging at a gap between the charging roller 2*a* and the photoreceptor 1, each of which has a curvature, thereby uniformly charging the surface of the photoreceptor 1.

When the charging roller 2*a* is contacted with the photoreceptor 1, the charging roller 2*a* preferably has an elastic layer so that the surface of the charging roller 2*a* can be securely contacted with the surface of the photoreceptor 1. For example, electroconductive rubbers having a JIS-A hardness of from 30 to 80° or electroconductive sponges having an ASKER-C hardness of from 15 to 60° are preferably used for the elastic layer. Suitable electroconductive materials for use in the elastic layer include materials such as NBRs, DRs, EPDMs and urethane rubbers, which include an electroconductive filler such as carbon blacks and titanium oxides, materials having an ionic conductivity such as epichlorohydrin rubbers, and combinations thereof.

When the charging roller 2*a* is used as a short range charger and is set to be close to the photoreceptor 1 with a small gap therebetween, it is preferable to precisely control the gap. Therefore, it is preferable that the charging roller has an elastic layer having a high JIS-A hardness of from 70 to 90° or a resin layer so that the charging roller has a diameter with high precision. Various resins such as acrylic resins, polyurethane resins, polyethylene resins, polystyrene resins, ABS resins, polycarbonate resins, and fluorine-containing resins can be used for the resin layer while an electroconductivity controlling agent is included therein such that the volume resistivity thereof is controlled so as to be from $10^6$ to $10^{10}$ Ω·cm.

In order to control the gap between the surface of the charging roller 2*a* and the surface of the photoreceptor 1 so as to be uniform, the charging roller preferably has the configuration as illustrated in FIG. 3.

Referring to FIG. 3, a spacer roller 2*a*1 is provided on each of longitudinal end portions of the charging roller 2*a* so as to be contacted with the surface of the photoreceptor 1 such that the gap between the surface of the charging roller 2*a* and the surface of the photoreceptor 1 is controlled so as to have a length of H. Alternatively, the charging roller has other configurations such that a tape is wound around the surface of the longitudinal end portions such that the thickness of the wound tape has a thickness of H; and the shaft of the charging roller is supported so as to form the predetermined gap therebetween. In addition, an elastic member 50 such as springs is preferably provided to press the charging roller 2*a* toward the photoreceptor. In this case, the gap is controlled more precisely.

In this example, the gap between the surface of the charging roller 2*a* and the surface of the photoreceptor 1 is preferably from 10 to 500 μm. The gap is preferably as narrow as possible because the voltage applied to the charging roller 2*a* can be reduced, resulting in decrease of the running costs of the image forming apparatus 100. However, in order to securely maintain such a narrow gap, the dimensional precision of parts constituting the charger 2 and the photoreceptor 1 has to be further improved. In addition, when the gap is too narrow, the chance of contact of foreign materials (such as toner particles and paper dusts) with the surface of the charging roller 2*a* is increased, resulting in contamination of the charging roller 2*a*. Therefore, the gap is more preferably from 30 to 60 μm.

The charging roller 2*a* preferably has an outermost layer having smooth surface and good releasability such that the surface of the roller is not easily contaminated with foreign materials whether the charging roller is a contact charging roller or a short range charging roller. Therefore, the surface of the charging roller 2*a* preferably includes a material having good releasability such as fluorine-containing materials and silicones.

In the image forming apparatus 100, the charger 2 uniformly charges the photoreceptor 1 such that the photoreceptor has a predetermined negative potential. Then the light irradiator 3 irradiates the charged photoreceptor 1 with imagewise light to form an electrostatic latent image on the photoreceptor 1. The developing device 4 develops the electrostatic latent image with a developer including a negatively charged toner such that the toner adheres to the lighted image portion of the photoreceptor 1.

In the charging process, the photoreceptor 1 is charged with the charging roller 2*a* so as to have a potential of about −700V. In this regard, voltage application methods are broadly classified into two bias application methods. One of the methods is a DC bias application method in which a DC bias of about −1400V is applied to the charging roller 2*a* such that the photoreceptor has a potential of about −700V. This method has an advantage such that a simple power source can be used therefor, but has a drawback in that the photoreceptor is unevenly charged even when the charging roller is slightly contaminated.

The other voltage application method is a DC-AC bias application method, in which a DC voltage overlapped with an AC voltage is applied and which can remedy the drawback of the DC bias application method. In the DC-AC bias application method, an AC voltage having a peak-to-peak voltage of about 1400V, which is about twice the discharge starting voltage, is overlapped. Therefore, when the photoreceptor 1 passes through the charging region, a number of discharging phenomena occur, and thereby the photoreceptor can be uniformly charged and in addition charging is hardly influenced by a contaminated charging roller. However, the DC-AC bias application method has drawbacks in that the photoreceptor sustains much electrostatic damage from the charging roller; and the power source has a high cost. Therefore, it is preferable to use the DC bias application method or the DC-AC bias application method depending on characteristics of the image forming apparatus for which the charger is used.

The light irradiator 3 processes the image data obtained by scanning an original image with a scanner of the image reading section 20 or image signals sent from an outside device such as PCs, and irradiates the photoreceptor 1 with imagewise light 3*a* via an optical device such as mirrors to form an electrostatic latent image on the photoreceptor 1.

The developing device 4 uses a two component developer including a toner and a particulate magnetic material serving as a carrier. The developing device includes a developer bearing member 4*a* configured to bear the developer, a toner supplying room, etc.

The developer bearing member 4*a* has a cylindrical form and includes a magnet roller, which is fixed inside the developer bearing member 4*a* (i.e., which is not rotated) although the developer bearing member 4*a* is rotated. The developer bearing member 4*a* is arranged so as to be close to the photoreceptor 1 while a small gap is formed therebetween. In addition, the developing device 4 includes a developer thickness controlling member configured to form a developer layer having a predetermined thickness on the developer bearing member 4*a*. The developer bearing member 4*a* feeds the developer layer having a predetermined thickness while bearing the developer layer on the peripheral surface thereof by means of the magnetic force of the magnetic roller. The developer bearing member 4*a* is typically made of a non-magnetic electroconductive material, and is connected with a power source (not shown) which applies a developing bias to the developer bearing member 4*a*. A voltage is applied to the developer bearing member 4*a* and the photoreceptor 1 to form an electric field in the developing region.

The image forming apparatus 100 illustrated in FIG. 1 uses a direct transfer method in which a toner image formed on the photoreceptor 1 is directly transferred to a receiving material. Therefore, the transfer device 6 includes a transfer belt 6*a*, a transfer bias roller 6*b*, a tension roller 6*c* and a roller 6*d* as illustrated in FIG. 2.

The transfer bias roller 6*b* has a configuration such that an elastic layer is formed on a shaft of a metal such as iron, aluminum and stainless steel. A pressure is applied to the transfer bias roller 6*b* so that the receiving material is closely contacted with the photoreceptor 1.

The transfer belt 6*a* includes a seamless support made of a heat resistant material such as polyimide films. It is preferable to form an outermost layer including a fluorine-containing resin to impart good releasability to the transfer belt. In this case, a silicone rubber layer can be formed between the support (polyimide film) and the outermost layer (fluorine-containing resin).

The tension roller 6*c* and the roller 6*d* rotate the transfer belt 6*a* while stretching the transfer belt.

The image forming apparatus 100 illustrated in FIG. 1 is a monochrome image forming apparatus which includes only one photoreceptor to produce monochrome images. However, the image forming apparatus of the present invention is not limited thereto, and may be an image forming apparatus which includes one or more photoreceptors and plural developing devices to form a multi-color image by performing plural color toner image transfer operations. In this image forming apparatus, an intermediate transfer method in which the color toner images formed on the photoreceptor(s) are transferred one by one on an intermediate transfer medium to form a multi-color toner image thereon and the multicolor toner image is then transferred onto a receiving material can also be used.

The fixing roller 7 includes a fixing roller including a heater (such as halogen lamps) therein, which heats a toner image on a receiving material to fix the toner image on the receiving material, and a pressure roller configured to press a receiving material toward the fixing roller.

The fixing roller typically includes a metal shaft, an elastic layer which is made of an elastic material such as silicone rubbers and which has a thickness of from 100 to 500 μm (more preferably about 400 μm), and an outermost layer which is typically made of a resin having good releasability such as fluorine-containing resins to prevent the toner image from adhering to the fixing roller. The outermost resin layer is typically made of a PFA tube, etc., and preferably has a thickness of from 10 to 50 μm in consideration of mechanical abrasion of the layer.

A temperature detector is provided to measure the temperature of the peripheral surface of the fixing roller and to control the temperature thereof so as to be in a range of from about 160° C. to about 200° C.

The pressure roller includes a metal shaft, and an offset preventing layer made of a material such as tetrafluoroethylene-perfluoroalkyl vinyl ether copolymer (PFA) and polytetrafluoroethylene (PTFE). Similarly to the fixing roller, an elastic layer such as silicone rubbers can be formed between the metal shaft and the offset preventing layer.

The fixing device is not limited to the device mentioned above. For example, belt fixing devices in which a belt is used instead of a fixing roller or a pressure roller can also be used. In addition, an induction heating (IH) fixing device in which toner images are heated using heat caused by eddy current generated by a magnetic force applied from outside.

Referring to FIG. 2, the cleaning device 8, which serves as cleaning means, includes a first cleaning blade 8*a*, a second cleaning blade 8*b* which is located on a downstream side from the first cleaning blade 8*a* relative to the rotation direction of the photoreceptor 1, a toner collection member 8*d* configured to collect the toner particles obtained by the cleaning operation and a toner collection coil 8*c* configured to feed the collected toner particles. In addition, the cleaning device 8 includes a toner collection box (not shown).

The first cleaning blade 8*a* is typically made of a material such as metals, resins and rubbers. Among these materials, rubbers such as fluorine-containing rubbers, silicone rubbers, butyl rubbers, butadiene rubbers, isoprene rubbers, and urethane rubbers are preferably used, and urethane rubbers are more preferably used. The first cleaning blade 8*a* mainly removes toner particles remaining on the surface of the photoreceptor even after a transfer operation.

The second cleaning blade 8*b* is provided to mainly remove materials adhered to the surface of the photoreceptor, such as films of additives in the toner formed on the surface of the photoreceptor. The material used for the second cleaning blade may be the same as that of the first cleaning blade. However, it is preferable that the second blade is made of an elastic material including an abrasive so that a film formed on the surface of the photoreceptor is easily removed therefrom.

The cleaning device 8 does not necessarily include the first and second cleaning blades, and a cleaning device having the first or second cleaning blade can also be used.

An optical device 9 serving as the charge decaying device irradiates the photoreceptor with light to decay charges remaining on the photoreceptor even after an image transfer operation, and includes a light source such as halogen lamps, LEDs and LDs.

In the image forming apparatus illustrated in FIGS. 1 and 2, the optical discharging device 9 uniformly irradiates the photoreceptor with LED light through a space between the first and second cleaning blades. In order to uniformly decay the residual charges, light irradiation is preferably performed on the photoreceptor after the cleaning operation, but may be performed after the image transfer operation and before the cleaning operation. In addition, the charge decaying device is not limited to the optical charge decaying device, and chargers such as corona chargers, roller chargers and brush chargers can be used for the charge decaying device.

The charging roller cleaning device will be explained referring to FIG. 2.

The cleaning device for cleaning the charging roller 2*a* includes a cleaning roller 2*b*, which serves as a cleaning member and which is made of a metal shaft covered with a cylindrical foamed resin.

Suitable materials for use as the foamed resin include foamed resins which have continuous air bubbles and which have a density of from 5 to 15 kg/m$^3$ and a tensile strength of from 1.7+/−0.5 kg/cm$^2$.

Among the foamed resins, foamed melamine resins are preferably used. This is because foamed melamine resins have hard network fibers and therefore foreign materials adhered to the surface of the charging roller 2*a* can be easily scraped off or peeled off by the network fibers. In addition, since the foamed melamine resins are brittle and therefore the surface thereof is easily abraded, the cleaning roller 2*b* has always a fresh surface and the fresh surface can be contacted with the charging roller 2*a*. Therefore, the cleaning roller has good cleanability.

In addition, foamed urethane resins and foamed EPDMs can also be used for the cleaning roller 2*b*. Further, brush rollers having hairs made of electroconductive fibers or dielectric fibers can also be used for the cleaning roller 2*b*. Specific examples of the brush rollers include brushes in which piles made of electroconductive acrylic or nylon fibers having a length of about 5 mm are fixedly set in a metal shaft; and brushes in which acrylic fibers having a length of from 1 to 3 mm are electrostatically planted on the surface of a metal shaft.

The cleaning roller 2*b* is rotatably supported. Namely, the cleaning roller 2*b* is rotated in a direction indicated by an arrow in FIG. 2 while driven by the charging roller 2*a*. Since the cleaning roller 2*b* is driven by the charging roller 2*a*, no driving device is necessary for rotating the cleaning roller 2*b*, and therefore the cleaning device can have a simple structure.

When the cleaning roller 2*b* is made of a foamed resin, the cleaning roller 2*b* has good cleanability even if a pressure is not particularly applied thereto. Therefore, abrasion of the surface of the charging roller 2*a* can be prevented.

The charging roller cleaning device preferably includes an oscillating mechanism configured to oscillate the cleaning roller 2*b* in the longitudinal direction thereof (i.e., the axial direction thereof) with rotation of the charging roller 2*a*. For example, the following oscillating mechanism can be used. Specifically, a bearing is provided on one end portion of the shaft of the cleaning roller 2*a* so as to be contacted with a cam of a gear with an oscillating cam. When the charging roller 2*a* is rotated, the gear is also rotated and thereby the cleaning roller 2*b* is oscillated in the longitudinal direction thereof. By oscillating the cleaning roller 2*b*, the surface of the charging roller 2*a* can be uniformly cleaned. Particularly, paper dust is typically produced from both end portions of receiving paper sheets, and therefore paper dust is mainly adhered to both end portions of the photoreceptor and the charging roller 2*a*. Even in this case, the paper dust can be well removed by oscillating the cleaning roller 2*b*.

The charging roller cleaning device can have a configuration other than that illustrated in FIG. 2. Specifically, a one-way clutch can be provided on one end portion of the shaft of the cleaning roller 2*b*. When an image forming operation is performed, the one-way clutch is locked and thereby the cleaning roller 2*b* is stopped. Since the charging roller 2*a* is rotated while the cleaning roller 2*b* is stopped, the surface of the charging roller is rubbed with the cleaning roller and thereby the surface of the charging roller is cleaned.

After one image forming operation is completed, the photoreceptor 1 is stopped after reversely rotated slightly and thereby the charging roller 2*a* is also stopped after reversely rotated slightly. Therefore, the cleaning roller 2*b* is also stopped after slightly rotated by the action of the one-way clutch. By using the cleaning roller with such a mechanism, unbalanced abrasion of the charging roller 2*a* can be prevented because the foamed resin portion of the cleaning roller 2*b* is softly contacted with the charging roller. In addition, since the portion of the cleaning roller 2*b* contacted with the charging roller 2*a* is changed after an image forming operation, the surface of the charging roller 2*a* can be well cleaned.

Next, the method for cleaning the surface of the charging roller 2*a* will be explained.

Even when the above-mentioned charging roller cleaning device is used, the foreign materials (such as toner particles and paper dust) remaining on the surface of the charging roller cannot perfectly removed therefrom. When the cleaning device is used for a long period of time, the residual foreign materials are accumulated on the charging roller, resulting in deterioration of the charging ability of the charging roller. In the present invention, in order to remove such residual foreign materials from the surface of the charging roller, the power source 2*c* applies a voltage to the charging roller 2*a* to form an electric field between the charging roller and the photoreceptor to return the residual foreign materials toward the photoreceptor.

In general, the potential of the photoreceptor 1 is decayed by the optical charge decaying device 9. Therefore, the photoreceptor 1 enters into the charging region (i.e., a region at which the charging roller faces or is contacted with the photoreceptor) while having a potential of about −100V.

In this embodiment, the potential difference between the charging roller 2*a* and the photoreceptor 1 is controlled so as to be a predetermined voltage, thereby forming an electric field between the charging roller and the photoreceptor. As a result, the charged particles (such as toner particles) adhered to the surface of the charging roller 2*a* are allowed to electrostatically fly to the photoreceptor 1 due to the thus formed electric field.

For example, when the power source 2*c* applied a voltage of −700V to the metal shaft of the charging roller 2*a* and the potential of the photoreceptor 1 is −100V, a potential difference of 600V is formed from the photoreceptor 1 toward the charging roller 2*a*. In this case, negatively charged particles (such as toner particles) adhered to the surface of the charging roller 2*a* are moved toward the photoreceptor 1 due to the thus formed electric field. In this regard, the potential difference of 600 v (i.e., the voltages −700V, and −100V) is a value for convenience sake. Specifically, the potential of the photoreceptor is changed when the photoreceptor faces the charging roller. The potential of a portion of the charging roller 2*a* facing the photoreceptor cannot be measured. By our calculation, the potential difference between a photoreceptor and a charging roller which are arranged with a gap of about 50 μm therebetween is about 250V and therefore the electric field intensity is $5\times10^6$ V/m.

In contrast, when a voltage of +500V is applied to the metal shaft of the charging roller 2*a* and the potential of the photoreceptor 1 is −100V, a potential difference of 600V is formed from the charging roller 2*a* toward the photoreceptor 1. In this case, positively charged particles adhered to the surface of the charging roller 2*a* are moved toward the photoreceptor 1 due to the thus formed electric field.

The present inventors made an experiment in which various potential differences are formed between the charging roller and the photoreceptor to observe to what extent the surface of the charging roller is cleaned (i.e., how many toner particles are moved toward the photoreceptor). The results are shown in Table 1.

Specifically, the experiment was made as follows. One hundred copies of an original image were continuously produced using the image forming apparatus while the cleaning devices for the photoreceptor 1 and the charging roller 2*a* are removed therefrom so that the surface of the charging roller is contaminated with toner particles. Next, the charging roller is rotated by several revolutions while the potential difference between the charging roller and the photoreceptor is maintained and the developing device 4 is removed from the image forming apparatus. The experiment was repeated while the potential difference (Vc−Vp) between the potential (Vc) of charging roller and the potential (Vp) of the photoreceptor was changed from −1000V to +1000V. The surface of the charging roller was visually observed to determine whether the degree of cleanliness of the charging roller is improved. The improvement degree of cleanliness of the charging roller is represented by numbers of from 5 (excellent) to 0 (bad).

TABLE 1

| Potential difference (Vc − Vp) (V) | Degree of improvement in cleanliness of charging roller (category) |
|---|---|
| −1000 | 2.0 |
| −800 | 2.5 |
| −600 | 4.0 |
| −500 | 4.5 |
| −400 | 4.0 |
| −200 | 3.0 |
| −100 | 2.5 |
| 0 | 0 |
| +200 | 2.0 |
| +400 | 3.0 |
| +600 | 2.0 |
| +800 | 1.5 |
| +1000 | 0 |

In the image forming apparatus used for the experiment, the potential difference at which discharging occurs at the gap between the surface of the charging roller and the surface of the photoreceptor (i.e., the surface of the photoreceptor is charged by discharging) is about 650V. As shown in Table 1, when the charging roller has a relatively high negative potential of from −500 to −700V, the degree of improvement in cleanliness of the charging roller (hereinafter sometimes referred to as cleaning effect) is greater. This is because the toner used for this experiment originally has a negative charge, and toner particles, which remain on the photoreceptor even after an image transfer operation and are then adhered accidentally to the charging roller, tend to have a negative charge. Therefore, when the negative potential of the charging roller is increased while preventing occurrence of discharging between the charging roller and the photoreceptor, the toner particles adhered to the charging roller receive an electrostatic repulsion and fly toward the photoreceptor.

As shown in Table 1, when the potential difference is too high (e.g., −800 to −1000V), the cleaning effect deteriorates. The reason therefor is considered to be that discharging occurs between the charging roller and the photoreceptor, and as a result, charges of the photoreceptor and the toner are drastically changed.

Specifically, when a DC bias of, for example, −800V is applied to the charging roller 2*a* and discharging occurs between the charging roller and the photoreceptor, which has a potential of −100V, positive charges are transferred from the photoreceptor 1 to the charging roller 2*a*. Therefore positive charges are deposited on the foreign materials adhered to the surface of the charging roller, i.e., the materials are positively charged. Therefore, the materials on the charging roller cannot fly toward the photoreceptor. Namely, the cleaning effect deteriorates when a bias of −800V is applied to the charging roller 2*a*.

In the above-mentioned example, a DC bias is applied to the charging roller 2*a*. When a DC bias overlapped with an AC bias is applied, discharging tends to occur more frequently while the direction of the electric field is frequently changed than in the case where a DC bias is used. Therefore, the polarity of the materials adhered to the charging roller is frequently changed. Specifically, if a charged material adhered to the charging roller is allowed to fly to the photoreceptor at a moment due to the electric field formed between the charging roller and the photoreceptor, the charged material is soon allowed to return to the charging roller because an electric field having a reverse direction is applied thereto due to application of an AC bias. Therefore, the cleaning effect deteriorates.

Thus, it is clear from Table 1 that the potential difference between the charging roller and the photoreceptor before the charging roller reaches the charging region at which the charging roller charges the photoreceptor is less than the discharge starting voltage.

Figure 4:
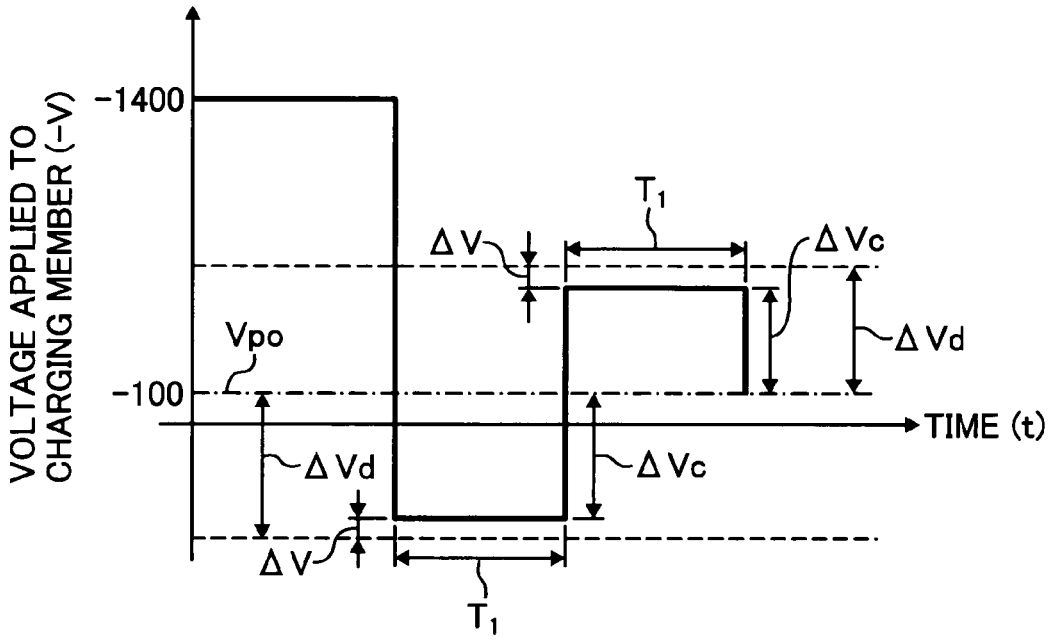
FIG. 4 is a timing chart for explaining an example of the method for applying a voltage to the charging roller.

FIG. 4 illustrates changes of the voltage of the charging roller. In this case, a DC voltage is applied to the charging roller. In addition, the photoreceptor has a potential (Vpo) of −100V before reaching the charging region and after being subjected to an optical charge decaying operation.

When a DC bias of −1400V is applied to the charging roller, the potential difference between the charging roller and the photoreceptor is −1300V and thereby discharging occurs therebetween, resulting in charging of the photoreceptor. When a voltage of ±400 to 500V is applied, the potential difference (ΔVc) is about 300 to 600V, which is lower by ΔV than the discharge starting voltage (ΔVd), and therefore discharging does not occur. In this case, the materials adhered to the charging roller are allowed to fly to the photoreceptor. As illustrated in FIG. 4, it is preferable that the potential difference (ΔVc) is maintained for at least a period of time $T_1$ over which the entire peripheral surface of the charging roller faces the photoreceptor. Namely, $T_1$ denotes the time over which the charging roller rotates by one revolution. When the charging roller is rotated at a higher (lower) speed, the time $T_1$ becomes shorter (longer).

When the charging roller is a short range charger, it is possible to rotate charging roller in a direction opposite to that of the photoreceptor (for example, by providing a bearing on the end portion of the charging roller). In this case, a voltage is applied to the charging roller for a period of time over which the charging roller rotates by one revolution.

As illustrated in FIG. 4, it is preferable to alternately form a positive potential difference and a negative potential difference. In this case, negatively charged toner particles, which remain on the photoreceptor even after a cleaning operation and are then adhered to the charging roller, can be well removed when a negative potential difference is formed while positively charged materials on the charging roller (such as free external additives released from the toner) are also well removed when a positive potential difference is formed.

Figure 5:
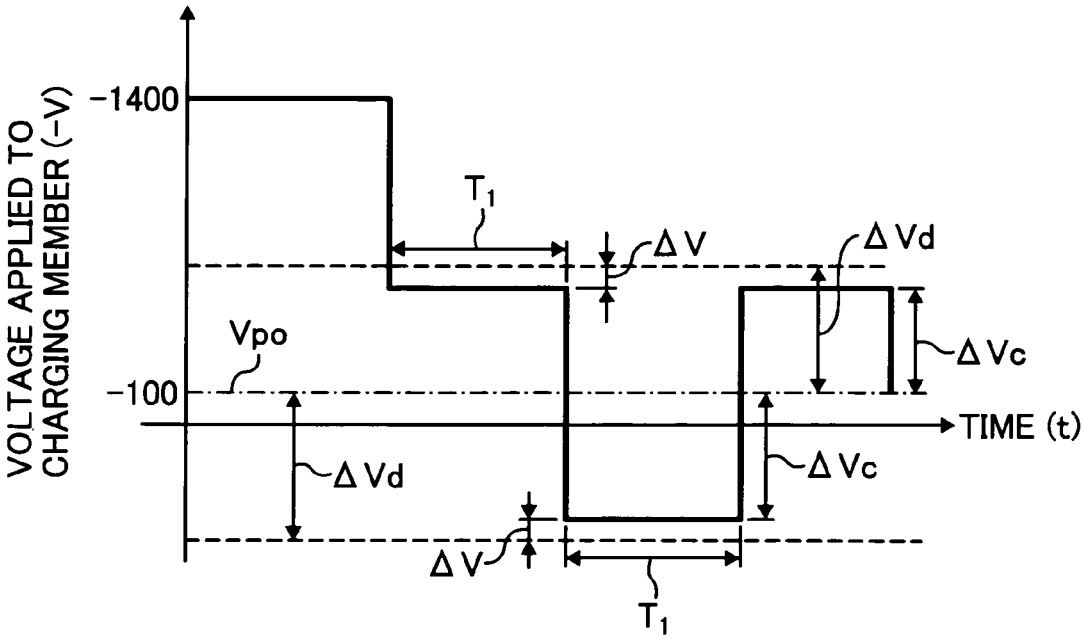
FIG. 5 is a timing chart for explaining another example of the method for applying a voltage to the charging roller.

More preferably, the charging method illustrated in FIG. 5 is used. Specifically, after a positive potential difference and a negative potential difference are alternately formed, a negative potential difference is finally formed to well remove toner particles adhered to the charging roller, in the case where a negatively-charged toner is used.

When the charging roller cleaning operation is performed, the voltage applied to the charging roller is preferably controlled so as to be uniform. The reason therefor is as follows. The potential of the photoreceptor changes while being influenced by the environmental conditions and the image formed just before the cleaning operation. Therefore, if the voltage applied to the charging roller is changed, there is a possibility that discharging occurs between the charging roller and the photoreceptor.

However, when the voltage applied to the charging roller is changed within a non-discharging range in which discharging is not caused, the cleaning effect can be enhanced. The present inventors made an experiment in which the voltage (i.e., amplitude voltage) of the DC/AC combination bias applied to the charging roller is changed from 0 to 1200V to check the cleaning effect (degree of improvement in cleanliness). The results are shown in Table 2.

TABLE 2

| Amplitude voltage of AC bias (V) | Degree of improvement in cleanliness (category) |
|---|---|
| 0 | 4.0 |
| 300 | 4.5 |
| 600 | 4.0 |
| 900 | 2.5 |
| 1200 | 2.0 |

In the experiment, a potential difference of −400V is formed between the charging roller and the photoreceptor by a DC voltage. An AC bias having a frequency of 1.0 kHz is added while the amplitude voltage of the AC bias is increased from 0 to 1200V. The degree of improvement in cleanliness is evaluated by the same method mentioned above.

It is clear from Table 2 that when the amplitude voltage of the AC bias is 300V (at which discharging is not caused because the potential difference is changed from −250 to −550V), the degree of improvement in cleanliness is high. When the amplitude voltage of the AC bias is 600V (in which the potential difference is changed from −100 to −700V), the degree of improvement in cleanliness slightly deteriorates because discharging is caused at a potential difference of about −700V. When the amplitude voltage of the AC bias is further increased, the degree of improvement in cleanliness seriously deteriorates.

Figure 6:
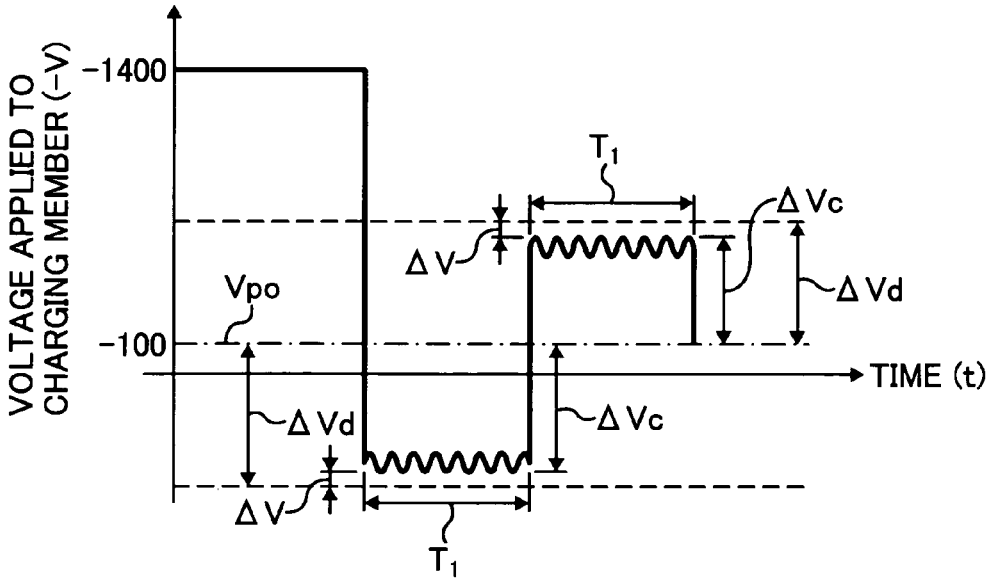
FIG. 6 is a timing chart for explaining another example of the method for applying a voltage to the charging roller.

In consideration of these results, it is preferable to use the DC/AC combination bias application method as illustrated in FIG. 6. Specifically, the potential difference (ΔVc) is controlled so as to be less than the discharge starting voltage (ΔVd).

By adding an AC bias, the electric field is repeatedly strengthened and weakened and thereby the materials adhered to the charging roller are shaken. Therefore, the materials tend to be easily released from the charging roller, resulting in enhancement of the cleaning effect.

When the bias applied to the charging roller is suddenly changed from a positive bias to a negative bias or vice versa, there is a case where the particles flying toward the photoreceptor return to the charging roller, resulting in deterioration of cleaning effect. In order to prevent occurrence of such a problem, it is preferable that an intermediate bias is applied to the charging roller so that the charging roller has almost the same potential as that of the photoreceptor before changing the bias. This bias application method is illustrated in FIG. 7.

Figure 7:
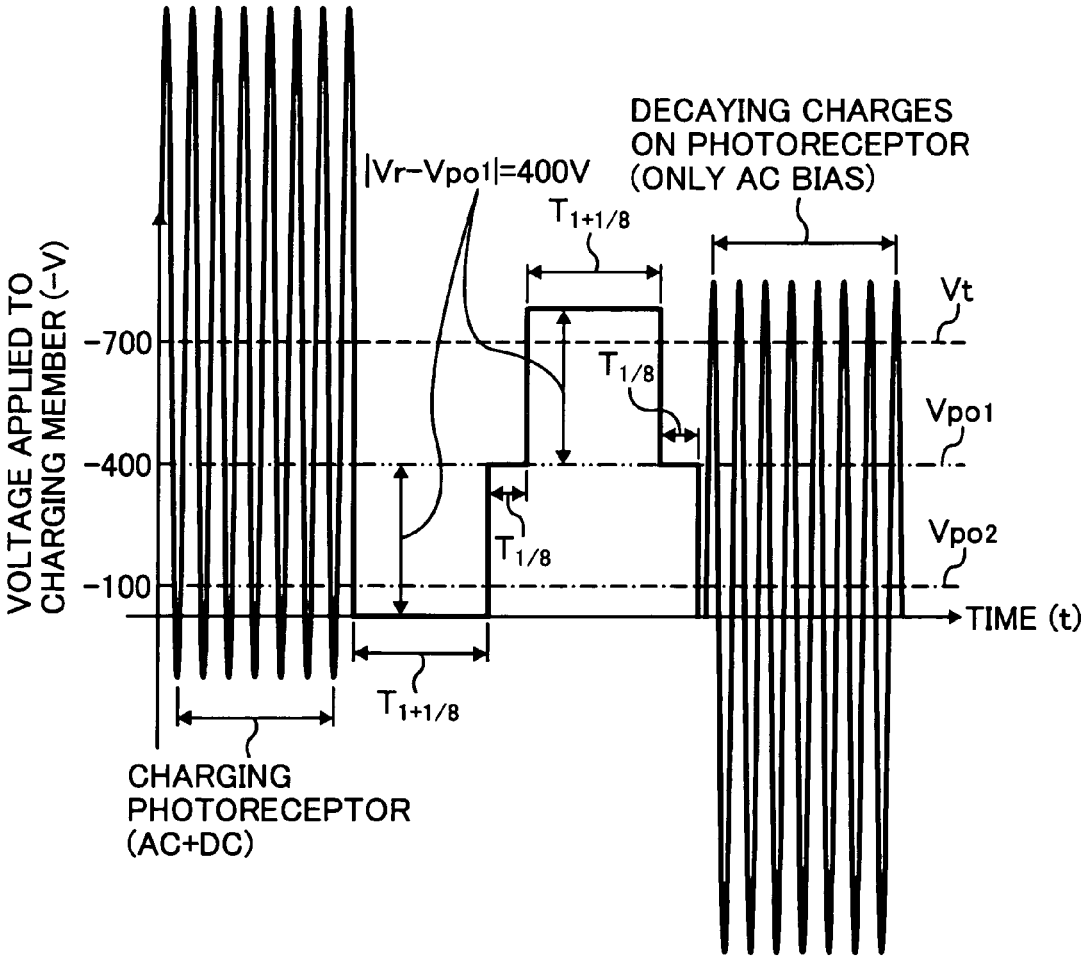
FIG. 7 is a timing chart for explaining how the potential of a point of the photoreceptor is changed with time.
Figure 8:
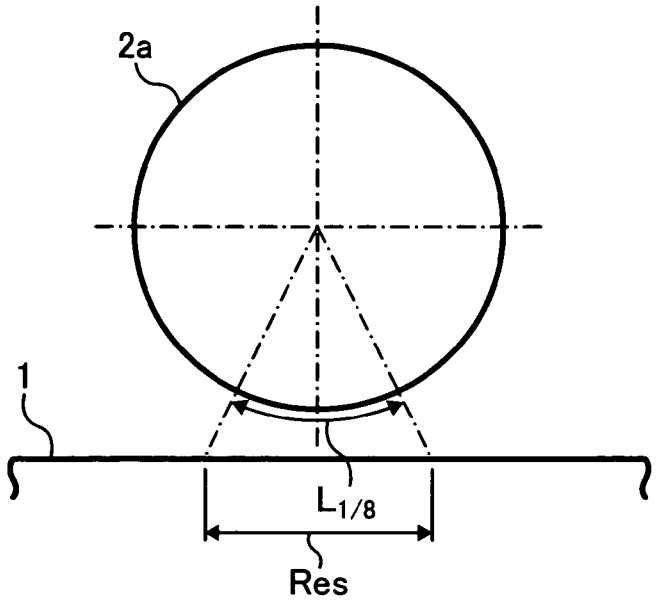
FIG. 8 is a schematic view illustrating the portion of the photoreceptor on which an electric field acts.

Referring to FIG. 7, after discharging (AC+DC) for charging the photoreceptor is completed and the photoreceptor entering into the charging region has a potential of Vpo.sub.1 (which is about −400V in this case), a bias (Vr) of 0V is applied to the charging roller to form a potential difference ($Vr-Vpo_1$) of 400V. After the charging roller is rotated by 1.25 (1+⅛) revolution (i.e., after a time ($T_1$+⅛) passes), a bias of −400V is applied to the charging roller for a time ($T_{1/8}$) in which the charging roller is rotated by 0.25 (⅛) revolution. This interval is preferably not shorter than the time. This is because it is considered by calculation that as illustrated in FIG. 8, about one eighth ($L_{1/8}$) of the peripheral surface of the charging roller 2*a* receives an electric field of the photoreceptor. In FIG. 8, character Res denotes the portion of the photoreceptor on which an electric field strongly acts. Referring back to FIG. 7, a bias of −800V is then applied to the charging roller for a time in which the charging roller is rotated by 1.25 (1+⅛) revolution. Further, a bias of −400V is applied to the charging roller for a time ($T_{1/8}$) during which the charging roller is rotated by 0.25 (⅛) revolution. After completion of this cleaning operation, an AC bias is applied to the charging roller to decay the charges remaining on the photoreceptor such that the potential of the photoreceptor is decreased from $Vpo_1$ to $Vpo_2$.

In the embodiment mentioned above, it is assumed that when an electric field is formed by applying a bias to the charging roller, the photoreceptor has been subjected to an optical charge decaying treatment and has a potential of about −100V. Therefore, at the charging region in which the photoreceptor faces the charging roller, the potential difference is less than the discharge starting voltage (ΔVd). Therefore the portion of the photoreceptor is not charged. Then this portion of the photoreceptor reaches the developing region.

In the image forming apparatus of the present invention, the developing method is not particularly limited. However, in any developing methods (such as one component developing methods and two component developing methods), a toner is always contacted with the surface of the photoreceptor. Therefore, it is necessary that the portion of the photoreceptor having a potential of −100V is not developed with the toner at the developing region. In general, the potential difference (hereinafter sometimes referred to as background potential) between the developing device and the non-image area of the photoreceptor is preferably from 200 to 300V. Since the potential of the photoreceptor is −100V, the potential of the developing device is preferably controlled so as to be from +100 to +200V.

When the photoreceptor is negatively charged and a negatively charged toner is used for development, a negative developing bias is typically applied to the developing device using a power source. To use a power source capable of applying both a negative bias and a positive bias increases the manufacturing costs. Therefore, in reality the developing bias of 0V is applied to avoid increase of costs.

In this case, the potential difference is about 100V and therefore there is a possibility that a background development problem such that a background area of the photoreceptor is undesirably developed with a toner occurs.

The toner particles adhered to the background area are removed from the surface of the photoreceptor by a photoreceptor cleaner. However, all the residual toner particles cannot be removed by the cleaner and some toner particles pass through the cleaner and reach the charging roller. Therefore there is a possibility that the surface of the charging roller is contaminated by the toner particles.

In order to prevent occurrence of such a problem, it is preferable that charges remaining on the photoreceptor are not decayed during the charging roller cleaning operation. In the image forming apparatus, the photoreceptor 1 can maintain the potential (Vt) (i.e., the background potential) for a while after a charging operation. By not actively performing a charge decaying treatment (such as the optical charge decaying treatment mentioned above) on the photoreceptor during the charging roller cleaning operation, the photoreceptor maintains the desired potential (i.e., $Vpo_1$ in FIG. 7) at the charging region. In this case, occurrence of the background development problem can be prevented.

As mentioned above, the optical charge decaying treatment is not performed on the photoreceptor when the charging roller cleaning operation is performed. In addition, it is preferable not to apply a transfer bias or to apply a decreased transfer bias to the transfer device so that the potential of the photoreceptor is not seriously decreased.

The change of the potential of the photoreceptor will be explained referring to FIG. 9.

Figure 9:
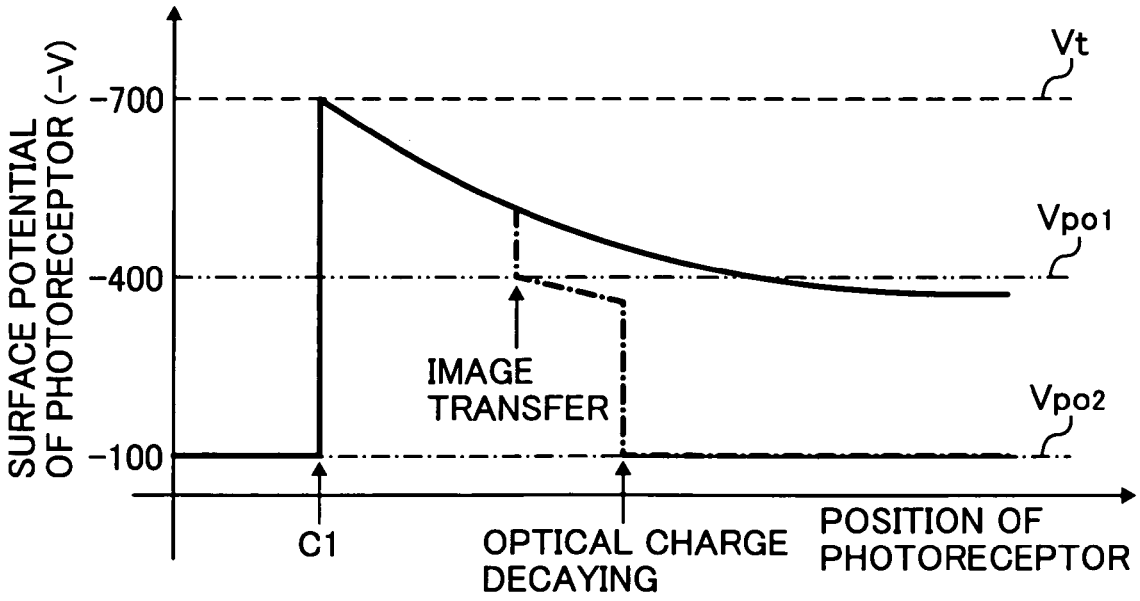
FIG. 9 is a timing charge for explaining how the potential of the photoreceptor is changed with time when a photoreceptor is or is not subjected to an optical discharging treatment.

FIG. 9 illustrates change of the potential of a point on the rotated photoreceptor. In FIG. 9, the potential of the photoreceptor, which is subjected to a transfer bias application treatment and an optical charge decaying treatment, is represented by dotted lines. Namely, the photoreceptor has a potential of $Vpo_1$ after an image transfer operation and a potential $Vpo_2$ after an optical charge decaying operation. The potential of the photoreceptor, which is not subjected to a transfer bias application treatment and an optical charge decaying treatment, is represented by a solid line.

When a transfer bias is not applied and an optical charge decaying treatment is not performed, the photoreceptor maintains a potential of about −400V as illustrated by a solid line, wherein the initial potential (Vt) of the photoreceptor is about −700V as illustrated by an uppermost dotted line. If the photoreceptor has such a potential, occurrence of the background development problem mentioned above can be prevented even when a developing bias of −100V is applied to the developing device because the potential difference at the developing region is from about +100 to about +200.

FIG. 7 illustrates change of the voltage applied to the charging roller 2*a* to form an electric field in a case where a transfer bias is not applied and an optical discharging treatment is not performed. In FIG. 7, the potential ($Vpo_1$) of a portion of the photoreceptor located just before the charging region is represented by a dotted line. The voltage applied to the charging roller is represented by a solid line.

In this embodiment, the conditions are as follows.

Linear speed of photoreceptor: 185 mm/s

Target potential (Vt) of photoreceptor: −700V

Frequency of AC bias overlapped: 1.2 kHz

Amplitude voltage of AC bias overlapped: 2.2 kV

The photoreceptor enters into the charging region while having a potential of about −400V if a transfer bias is not applied and an optical charge decaying treatment is not performed. When the portion of the photoreceptor enters into the charging region, the charging bias is set so as to be 0V. In this case, an electric field in a direction of from the charging roller to the photoreceptor is formed, and thereby positively charged materials on the charging roller are allowed to fly to the photoreceptor. This condition is maintained for a time during which the charging roller is rotated by 1.25 (i.e., 1+⅛) revolution. Therefore the entire surface of the charging roller is cleaned. Then the potential of the charging roller is controlled so as to be the same as that of the photoreceptor for a time in which the charging roller is rotated by 0.25 (i.e., ⅛) revolution. Then a bias of −800V is applied to the charging roller to allow the negatively charged materials on the charging roller to fly to the photoreceptor. This condition is also maintained for a time in which the charging roller is rotated by 1.25 (i.e., 1+⅛) revolution. Therefore the entire surface of the charging roller is cleaned. Then the potential of the charging roller is controlled again so as to be the same as that of the photoreceptor for a time in which the charging roller is rotated by 0.25 (i.e., ⅛) revolution. Finally, only an AC bias is applied to the charging roller without applying a DC bias for a time in which the photoreceptor is rotated by one revolution. After these operations, the image forming section is stopped.

This charging roller cleaning operation is preferably performed after an image forming operation is completed. When this cleaning operation is performed before an image forming operation, the waiting time before first image formation is prolonged, which is not preferable.

The photoreceptor 1 and the charging device 2 can be unitized as a process cartridge, which can be detachably attached to the image forming apparatus 100. The process cartridge can further include the developing device 4, the photoreceptor cleaning device 8, etc.

The process cartridge is a unit which is replaced with new one when the life of one or more parts therein expires. In the present invention, the life of the charging roller 2*a* can be prolonged by using the cleaning method mentioned above, and therefore the life of the process cartridge can be prolonged.

The image forming apparatus of the present invention is not limited to the image forming apparatus illustrated in FIG. 1. For example, the toner image formed on the photoreceptor can be transferred onto an intermediate transfer medium, and the toner image is then transferred onto a receiving material. Further, the image forming apparatus of the present invention may be a multi-color image forming apparatus in which plural color toner images are formed on one photoreceptor or the respective photoreceptors; the color toner images are then transferred onto an intermediate transfer medium to form a multi-color toner image thereon; and the multi-color toner image is then transferred onto a receiving material.

This document claims priority and contains subject matter related to Japanese Patent Application No. 2005-193044, filed on Jun. 30, 2005, incorporated herein by reference.

Having now fully described the invention, it will be apparent to one of ordinary skill in the art that many changes and modifications can be made thereto without departing from the spirit and scope of the invention as set forth therein.

What is claimed is:

1. An image forming method, comprising:

charging a rotating latent image bearing member with a rotating charger selected from at least one of contact chargers and short range chargers;

irradiating the rotating latent image bearing member with imagewise light to form an electrostatic latent image on the latent image bearing member;

developing the electrostatic latent image with a developer including a toner having a charge to form a toner image on the latent image bearing member;

transferring the toner image onto a receiving material; and after transferring the toner image, forming an electric field between the charger and the latent image bearing member so that charged materials present on a surface of the charger fly toward the latent image bearing member, wherein forming the electrical field includes:

forming the electric field between the charger and the latent image bearing member while changing directions of the electric field by setting a potential of the charger to be lower and higher than a potential of a photoreceptor, in a first direction, charged materials having a charge with a first polarity on the surface of the charger fly toward the latent image bearing member, and in a second direction, charged materials having a charge with a second polarity on the surface of the charging member fly toward the latent image bearing member.

2. The image forming method according to claim 1, wherein the electric field forming comprises:

forming an electric field between the charger and the latent image bearing member after the toner image transferring by forming a potential difference of less than a discharge starting voltage between the charger and the latent image bearing member.

3. The image forming method according to claim 2, wherein the electric field forming comprises:

forming an electric field between the charger and the latent image bearing member after the toner image transferring by forming a potential difference of less than a discharge starting voltage between the charger and the latent image bearing member for a period of time in which the charging roller rotates by at least one revolution.

4. The image forming method according to claim 1, wherein the second polarity is the same as a polarity of the charge of the toner.

5. The image forming method according to claim 1, wherein the electric field forming comprises:

forming an electric field between the charger and the latent image bearing member by applying a DC voltage to the charging roller.

6. The image forming method according to claim 1, wherein the electric field forming comprises:

forming an electric field between the charger and the latent image bearing member after the toner image transferring by applying a DC voltage overlapped with an AC voltage to the charging roller such that a potential difference between the charger and the latent image bearing member is less than a discharge starting voltage.

7. The image forming method according to claim 1, wherein the electric field forming comprises:

forming an electric field between the charger and the latent image bearing member after the toner image transferring such that charged materials present on the surface of the charging member fly toward the latent image bearing member without actively decaying charges remaining on a surface of the latent image bearing member after the toner image transferring.

8. The image forming method according to claim 1, wherein the electric field forming comprises:

forming an electric field between the charger and the latent image bearing member after the toner image transferring such that charged materials present on the surface of the charger fly toward the latent image bearing member, wherein at least a portion of the latent image bearing member facing the charger in the electric field forming has received a transfer bias different from that applied to the latent image bearing member in the image transferring.

9. The image forming method according to claim 1, wherein the electric field forming is performed a predetermined time after completion of an image forming operation including the charging, imagewise light irradiating, developing and image transferring.

10. An image forming apparatus comprising:

a latent image bearing member;

a charger configured to charge the latent image bearing member;

a light irradiator configured to irradiate the charged latent image bearing member with imagewise light to form an electrostatic latent image on the latent image bearing member;

a developing device configured to develop the electrostatic latent image with a developer including a toner to form a toner image on the latent image bearing member;

a transferring device configured to transfer the toner image onto a receiving material; and an electric field applicator configured to form an electric field between the charger and the latent image bearing member after the toner image on the latent image bearing member is transferred such that charged materials present on the surface of the charger fly toward the latent image bearing member, wherein the formed electrical field includes:

forming the electric field between the charger and the latent image bearing member while changing directions of the electric field by setting a potential of the charger to be lower and higher than a potential of a photoreceptor, in a first direction, charged materials having a charge with a first polarity on the surface of the charger fly toward the latent image bearing member, and in a second direction, charged materials having a charge with a second polarity on the surface of the charging member fly toward the latent image bearing member.

11. A process cartridge unit, comprising:

a latent image bearing member;

a charger configured to charge the latent image bearing member; and an electric field applicator configured to form an electric field between the charger and the latent image bearing member such that charged materials present on the surface of the charger fly toward the latent image bearing member, wherein the formed electrical field includes:

forming the electric field between the charger and the latent image bearing member while changing directions of the electric field by setting a potential of the charger to be lower and higher than a potential of a photoreceptor, in a first direction, charged materials having a charge with a first polarity on the surface of the charger fly toward the latent image bearing member, and in a second direction, charged materials having a charge with a second polarity on the surface of the charging member fly toward the latent image bearing member, and wherein the process cartridge unit is detachably set to an image forming apparatus as a unit.

* * * * *